United States Patent [19]

Knapp

[11] Patent Number: 4,618,243

[45] Date of Patent: Oct. 21, 1986

[54] APPARATUS FOR COLOR DEVELOPMENT WITH A MAGNETIC SEPARATOR CONTAINING A STATIONARY SHELL WITH ROTATING MAGNETS

[75] Inventor: John F. Knapp, Fairport, N.Y.

[73] Assignee: Xerox Corporation, Stamford, Conn.

[21] Appl. No.: 672,002

[22] Filed: Nov. 16, 1984

[51] Int. Cl.[4] ..... G03G 15/01; G03G 15/08

[52] U.S. Cl. ..... 355/4; 355/3 DD; 355/14 D; 355/15; 118/645; 118/657; 430/122

[58] Field of Search ..... 355/3 DD, 14 D, 4, 15; 118/645, 651, 640, 652, 657; 430/120, 122

[56] References Cited

U.S. PATENT DOCUMENTS

| | | | |
|---|---|---|---|
| 3,239,465 | 3/1966 | Rheinfrank | 252/62.1 |
| 4,030,445 | 6/1977 | Takenaga et al. | 118/645 |
| 4,045,219 | 8/1977 | Bean | 96/1.2 |
| 4,165,165 | 8/1979 | Iwami et al. | 355/4 |
| 4,235,194 | 11/1980 | Wada et al. | 355/3 DD X |
| 4,239,845 | 12/1980 | Tanaka et al. | 430/122 |
| 4,264,185 | 4/1981 | Ohta | 355/4 |
| 4,384,545 | 5/1983 | Burnham et al. | 118/651 |
| 4,483,611 | 11/1984 | Matsura et al. | 355/15 |
| 4,533,235 | 8/1985 | Uchida | 355/15 |
| 4,537,494 | 8/1985 | Lubinsky et al. | 355/16 X |

*Primary Examiner*—A. G. Prescott
*Attorney, Agent, or Firm*—E. O. Palazzo

[57] ABSTRACT

An improved apparatus for causing the development of electrostatic latent images on an imaging member consisting essentially of providing a moving deflected flexible imaging member, a moving toner transporting means, a development zone situated between said members, with the distance between the flexible imaging member and the transporting member being from about 0.05 millimeters to about 1.5 millimeters, a first developer reservoir with magnetic developer particles, a second developer reservoir with colored developer particles, and a magnetic separator comprised of a stationary shell with rotating magnets therein.

10 Claims, 2 Drawing Figures

APPARATUS FOR COLOR DEVELOPMENT WITH A MAGNETIC SEPARATOR CONTAINING A STATIONARY SHELL WITH ROTATING MAGNETS

BACKGROUND OF THE INVENTION

This invention generally relates to a process and an apparatus for effecting the development of color images. More specifically the present invention is directed to an improved process, and an improved apparatus for use in a single pass two-color development system, wherein contamination of the color developer is substantially eliminated. In one embodiment of the present invention there is provided in the development process and apparatus a magnet system which enables the removal of undesirable black toner particles from the color developer mixture. There is thus provided in an embodiment of the present invention an improved process, and an improved apparatus for obtaining color images by providing development zones encompassed by a moving deflected flexible imaging member and a moving transporting member, and wherein at one of the developer stations there is situated a magnet system for the purpose of removing black toner particles from the color developer composition reservoir thereby preventing contamination thereof. In this manner the process and apparatus of the present invention provides for the continual uncontaminated development of high quality images, particularly images of different colors, such as black and red, including the efficient and effective development of solid areas. Therefore, the problem of causing undesirable contamination of the colored toner composition black toner composition, for example, is uniquely solved in accordance with the process and apparatus of the present invention by positioning a magnet within the development apparatus.

The development of images by electrostatographic means is well known. Generally in these processes toner particles are applied to an electrostatic latent image by various methods including cascade development, reference U.S. Pat. 3,618,552; magnetic brush development, U.S. Pat. Nos. 2,874,063; 3,251,706 and 3,357,402; powder cloud development, U.S. Pat. No. 2,217,776; and touchdown development, U.S. Pat. No. 3,166,432. Cascade development and powder cloud development are especially well suited for the development of line images common to business documents, however, images with solid areas are not faithfully reproduced by these methods. Magnetic brush development systems, however, provided an improved method for reproducing both line images and solid areas.

In magnetic brush development systems, it is usually desirable to attempt to regulate the thickness of the developer composition, which is transported on a roller, by moving the roller past a metering blade. The adjustment of the metering blade is important, since in the development zone the flow of developer material is determined by a narrow restrictive opening situated between the transport roller and the imaging surface. Accordingly, in order to provide sufficient toner particles to the imaging surface, it is generally necessary to compress the developer bristles, thereby allowing toner particles adhering to the carrier particles near the ends of the bristle to be available for development. Any variation, or non-uniformity in the amount of developer metered onto the transport roller, or into the spacing between the transport roller and imaging member can result in undesired developer flow, and non-uniform image development. Non-uniform development is usually minimized by carefully controlling developer runout on the transport roller, and on the imaging member, and by providing a means for side-to-side adjustment in the relative positions of the metering blade, development roller and imaging member.

While several improved toner and carrier materials as well as processes have been developed for the purpose of obtaining images, many difficulties existed in designing a simple, inexpensive and reliable two-component development system which will provide high solid area development rates, low background deposition, and long term stability. This was accomplished with the process and apparatus as described in U.S. Pat. No. 4,394,429 entitled Development Process and Apparatus, the disclosure of which is totally incorporated herein by reference. There is illustrated in this patent a self-agitated two-component development process and apparatus wherein toner is continuously available immediately adjacent to a flexible deflected imaging member, and toner particles transfer from one layer of carrier particles to another layer of carrier particles in a development zone. More specifically, in one embodiment of the invention described in the 4,394,429 patent there is described an improved process for causing the development of electrostatic latent images on an imaging member comprising providing a development zone, ranging in length of from about 0.5 centimeters to about 5 centimeters, encompassed by a tensioned deflected flexible imaging member and a transporting member, wherein the flexible imaging member is comprised of a supporting substrate, a photogenerating layer, and a diamine hole transport layer. The deflected flexible imaging member and transporting member can be caused to move in opposite directions at certain specific speeds; and furthermore, there is usually maintained a distance of from about 0.05 millimeters to about 1.5 millimeters, between the flexible imaging member and the transporting member.

Furthermore, it is known that color images can be obtained in xerographic imaging systems. Specifically, two-color reproduction systems serving distinct needs are generally known; representational wherein the colors of the reproduction are equivalent to those of the original document; and functional wherein the color to be reproduced merely serves to mark, distinguish or highlight portions of a document such as a text, graphs, or line drawings. In representational color processes, images are xerographically produced, for example by three successive color filter exposures, followed by an in-register transfer of toner images produced by three toners of the appropriate primary attractive colors. These processes are complex in that they require the superimposition of images on three separate exposures, either in three successive cycles, or on a photoreceptor of sufficient circumference or length to accommodate the images prior to transfer. Also, it is known to use in such processes a series of three separate in-register photoreceptor drums each contributing one image to the final transfer sheet. However, these processes can be costly, and can result in images of poor resolution in view of their complexity, and the necessity of using three separate photoreceptor drums. In the simpler highlight color imaging systems, to which the present invention relates, generally only two colors need to be reproduced. Specifically, in highlight color processes there are produced two color documents wherein, for example black may be used to represent the main text, and red, blue, or other color selected portions of the text, which are to be directed to the users attention by means of the highlight color. Accordingly, there can be generated images in two colors, such as red and black, by desirably employing only one imaging operation.

Moreover, there is disclosed in U.S. Pat. No. 4,188,213, a method for producing color copies involving a number of complex steps including, for example, the recording of successive single color electrostatic latent images on an image bearing member, followed by developing each color electrostatic latent image with particles containing a predetermined dominant colorant therein corresponding to each recorded single color electrostatic latent image, transferring layers of the developed particles to a sheet of support material, and regulating electrically the transfer step in order that the successive thinner layers of particles are transferred from the image bearing member to a sheet of support material. Disclosed in this patent is a development method involving the deposition of particles containing a dominant cyan colorant with a minor magenta colorant impurity, on an electrostatic latent image formed from a red filtered image, depositing particles with a dominant magenta colorant with a minor yellow impurity on the electrostatic latent image formed from a green filtered light image, and depositing particles with a dominant yellow colorant on the electrostatic latent image formed from a blue filtered light image. Each successive layer of toner particles, which are transferred to a sheet of support material, is of a color corresponding to the color of impurity in the previously transferred layer of toner particles. Thus, successive layers of toner particles are transferred in superimposed registration with one another, with each successive transferred layer of toner particles correcting for the impurities in the colorant of the previously transferred layer of toner particles, thus producing a combination of toner particles substantially approximately the desired color.

The invention disclosed in U.S. Pat. No. 4,189,224 solves some of the problems of the process of the 4,188,213 patent, in that the method described therein requires only a single exposure to derive a two color image. Therefore, registration and multiple cycling steps are eliminated. More specifically, there is described in U.S. Pat. No. 4,189,224 a two color electrostatic copying apparatus which can be operable for one color positive or negative copying. In accordance with the teachings of this patent, a photoconductive material with a conductive substrate, an inner photoconductive layer sensitive to visible light, and an outer photoconductive layer insensitive to red light, is subjected to an electrostatic charge applied to the outer layer, while at the same time irradiating the device with light so as to render one of the layers conductive. Subsequently, an electrostatic charge of opposite polarity is applied to the outer layer of the photoresponsive member, this step being accomplished in the dark. A light image of an original document is then projected onto the outer layer of the photoresponsive device, wherein white areas of the image cause photoconduction of both layers and red areas thereof, enabling photoconduction of only the inner layer. As a result, white areas are of zero surface potential, while red and black areas have non-zero surface potentials of opposite polarities. The images can then be developed with red and black toner particles of opposite charge. Thus, for example, red particles which are charged positively will be caused to adhere to negatively charged image areas, while black toner particles which are charged negatively will adhere to the black image areas which are charged positively.

Also, disclosed in U.S. Pat. No. 4,078,929 is a single step electrostatographic copying process in which two different potential levels on a photoresponsive device may be developed in immediate sequence subsequent to a single exposure, by means of two differentially colored xerographic toners. The two potential levels may be of the same polarity or preferably of opposite polarities. In one embodiment of the invention disclosed in the 4,078,929 patent, positively charged toner particles of a first color, and negatively charged toner particles of a second color are about evenly concentrated in the relatively negative, and relatively positive areas of the imaging surface, thus allowing the positively charged toner particles to be attracted to the imaging surface with a negative charge pattern, while the negatively charged toner particles of a second color are attracted to the imaging surface with a positive charge pattern.

SUMMARY OF THE INVENTION

It is an object of the present invention to provide an improved process and apparatus for effecting development of color images.

In another object of the present invention there is provided an improved process and apparatus for single cycle two-color xerographic processes, such as the process as disclosed in U.S. Pat. No. 4,078,929, the subject matter of which is totally incorporated herein by reference.

In yet another object of the present invention there is provided an improved process and apparatus which enables red intelligence on an original document to be distinguished from black intelligence on a relatively white colored background.

In a further object of the present invention there is provided a process and apparatus wherein single cycle two-color imaging is affected and there is included in the development system magnets for the purpose of removing black toner particles from the reservoir with the color developer component thereby substantially eliminating contamination of this component.

In yet another object of the present invention there is provided a process and apparatus useful for producing images in a two-color system, for example black and red, black and green, or black and blue, all on a white background, and wherein there is included in the development system a magnetic separator, enabling the removal of black toner particles, and thus avoiding contamination of the color developer mixture.

In still another object of the present invention there is provided an improved process and apparatus with a moving deflected flexible imaging member, and a moving transporting member, reference U.S. Pat. No. 4,394,429, the disclosure of which is totally incorporated herein by reference, and a magnetic separator for the purpose of removing black toner particles, thereby preventing contamination of the color developer mixture.

These and other objects of the present invention are accomplished by providing a color development process and apparatus wherein toner is available continuously immediately adjacent to a flexible deflected imaging surface, and toner particles are transferred from one layer of carrier particles to another layer of carrier particles in a development zone. More specifically, there is provided in accordance with the present invention an improved process and apparatus for affecting the development of color images, especially black and red, comprising a transporting member, and a moving tensioned deflected flexible imaging member, a magnetic toner/developer reservoir, a reservoir with a colored developer mixture, and a separator means wherein black toner particles are attracted thereto enabling the substantial elimination of contamination of the color developer mixture. The developer particles are caused to be desirably agitated in a development zone situated between the deflected flexible imaging member and a transporting member, this agitation being dependent primarily on the arc or degree of deflection of the flexible imaging member, and the relative speeds of, and the distance between the flexible imaging member and the transporting member, while migration of the toner particles depends primarily on the magnitude of the electric field in the development zone. The details of this process and apparatus are described in U.S. Pat. No. 4,394,429, the disclosure of which is totally incorporated herein by reference. More specifically, there is described in this patent a process for causing the development of electrostatic latent images on an imaging member, comprising providing a development zone encompassed by a tensioned deflected flexible imaging member and a transporting member; causing the flexible imaging member to move at a speed of from about 5 cm/sec to about 50 om/sec; causing the transporting member to move at a speed of from about 6 cm/sec to about 100 cm/sec, said flexible member and said transporting member moving at different speeds; maintaining a distance between the flexible imaging member and the transporting member of from about 0.05 millimeters to about 1.5 millimeters; adding developer particles to the development zone, which particles are comprised of electrically insulating toner particles and magnetic carrier particles, wherein the developer particles in the development zone are agitated; and the insulating toner particles migrate from one layer of carrier particles to another layer of carrier particles in the development zone, the carrier particles rotating in one direction then subsequently in another direction whereby toner particles are continuously made available immediately adjacent the flexible imaging member, said process being accomplished in the absence of a magnetic field.

In another embodiment of the present invention there is provided an electrostatographic color imaging process and apparatus comprised of an imaging member means, a charging means, an exposure means, a development means, a transfer means and a fixing means, the improvement residing in the development means containing a deflected flexible imaging means; a transporting means; means for causing movement of the flexible imaging member means and the transporting means, which means are moving at different rates of speed; developer reservoir means containing therein magnetic developer particles; and a second developer reservoir with colored developer particles; and provided in close proximity to the second developer reservoir a magnetic separator means for affecting removal of black toner particles, enabling the substantial elimination of contamination of the color developer mixture.

The apparatus and process of the present invention is particularly useful for obtaining colored image copies in two colors such as red and black as disclosed hereinbefore. Illustrative examples of documents that may be subjected to the highlight color process of the present invention include technical journals such as Scientific American, a large portion of whose pages are printed in black and highlight color; engineering drawings, letters, reports, and a variety of other documents created by color inks, crayons, signature impression stamps, and typewriter ribbons.

BRIEF DESCRIPTION OF THE DRAWINGS

For a better understanding of the present invention and further features thereof, reference is made to the following detailed description of various preferred embodiments wherein.

DESCRIPTION OF THE PREFERRED EMBODIMENTS

Figure 1:
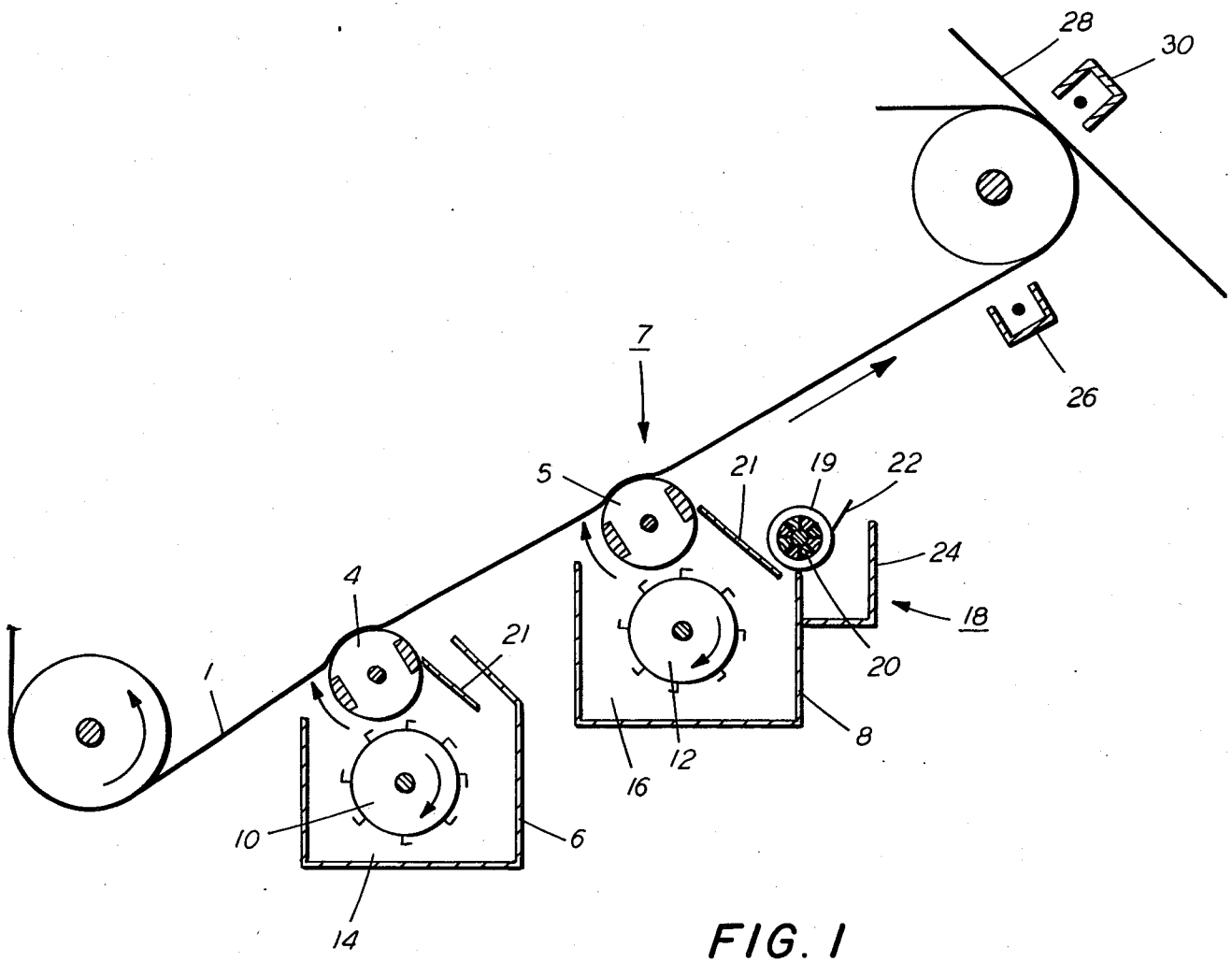
FIG. 1 is a partially schematic cross sectional view of the development process and apparatus of the present invention.

Illustrated in FIG. 1 is one embodiment of the development process and apparatus of the present invention designated 7, and comprised of a positively charged, deflected flexible imaging member 1, a developer transporting member 4, a developer reservoir 6, a developer reservoir 8, a paddlewheel 10, a paddlewheel 12, developer particles with positively charged black magnetic toner 14, color developer particles 16, magnetic separating apparatus 18, with a stationary shell 19, multiple rotating magnets 20, chutes 21, and a scrapper 22, reservoir 24, a positive precharge corotron 26, a paper substrate 28, a negative transfer corotron 30, a voltage source means, not shown, for the transporting means 4, and a voltage source means, not shown, for the transporting means 5. In operation subsequent to biasing the members 4 and 5, and after causing the formation of an electrostatic latent image on the flexible imaging member 1, magnetic developer particles are caused to migrate to the flexible imaging member 1 by paddlewheel 10, and the movement between the flexible imaging member and the transporting member. Thereafter, color developer particles in reservoir 16 are caused to deposit on the latent image contained on the flexible imaging member 1 by paddlewheel 12, and biased roll 5. Any black toner particles on transporting means 5 are removed therefrom by attraction to the rotating magnets 20 in the stationary shell 19; therefore, black toner particles are prevented from entering into the color developer mixture reservoir 8. The black toner particles are retained on the shell and transported away from the color developer by rotation of the magnets. Susequently, the black toner particles can be removed from the stationary shell and deposited in the reservoir 24 for later reuse in the system. The scrapper blade 22 assists in the removal of the black toner particles from the stationary shell.

With further reference to FIG. 1, the electrostatic image generally consists of three voltages, which are generated by varying the intensity from a laser exposure, or with a special document and light lens copying. Typically, black information to be printed is at about −800 volts; unprinted information (white) is at about −400 volts; and information to be printed in a color is more exposed to light, and is at zero (0) volts. Accordingly, in this embodiment, since the magnetic fields are relatively low black development can be easily achieved with a toner composition comprised of resin particles and a major amount of magnetite, exceeding 40 percent by weight. Also, a bias of about −450 volts on roll 4 prevents black toner deposition in color information areas, that is those with zero (0) volts thereon, and in white information areas with about −400 volts thereon. However, black toner particles are caused to deposit in the black information areas, which are at about −800 volts. Thereafter, the black developed image, and color electrostatic image is then transported through color development station 18. At this station, a developer is selected wherein the color toner is negatively charged. Further the bias on the transporting roll 5 is fixed at about −300 volts. This prevents development in white information areas, about −400 volts, as the toner is negatively charged, and it also prevents further color development in the previously printed black area, which remains at about −800 volts. These parameters also enable the color toner to develop in color information areas, that is those at about zero (0) volts. While the electrostatics on the imaging member are arranged to maintain the black toner on the photoconductive imaging member as it passes through the housing with color toner particles therein, mechanical scrubbing by the color developer composition causes undesirable black toner contamination thereof. Accordingly, with the process and apparatus as illustrated in FIG. 1 the undesirable black toner is removed from the color developer composition enabling the achievement of images with the appropriate color. Also, black toner is prevented from adversely affecting the color toner charge level.

Figure 2:
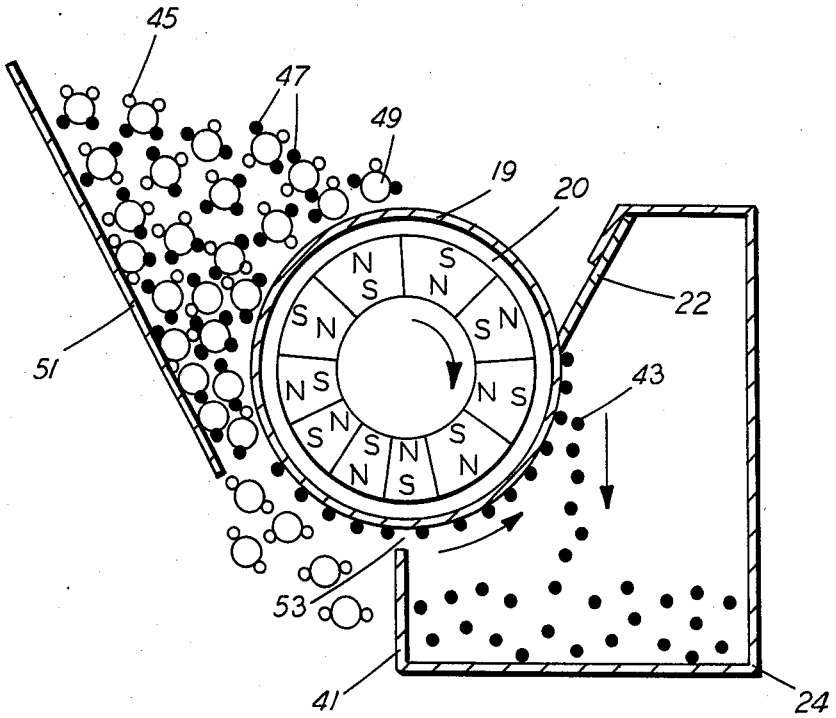
FIG. 2 is a schematic cross sectional view of the magnetic separator apparatus of the present invention.

Illustrated in FIG. 2 is the magnetic separator 18 of FIG. 1. There is thus illustrated in FIG. 2 a black toner magnetic separator comprised of a shell 19, rotating magnets 20, blade 22, a housing wall 41, a reservoir 24 comprised of the collected black toner particles 43, red toner particles 45, black magnetic toner particles 47, carrier beads 49, inclined chute 51, and spacing gap 53. Generally, in operation the contaminated developer composition comprised of red toner particles 45, black magnetic toner particles 47, and carrier beads 49, is removed downward along the incline chute 51 subsequent to removal from the transporting roll 5 of FIG. 1. The stationary shell 19, with internal rotating magnets 20 therein, magnetically extracts black magnetic toner from the contaminated color developer composition. The black toner collection reservoir 24 is spaced slightly from the shell enabling the toner to pass therethrough. The rotating magnets then transport black magnetic toner along the shell surface until removal thereof by scrapper blade 22 held in contact with the shell. Thereafter, the black magnetic toner removed is collected in reservoir 24 and can be discarded or reused. Clean color developer particles can also be continuously cycled into the color housing 8. Alternatively, the shell 19 can be caused to rotate if desired.

With further reference to FIG. 1, there is present in the developer reservoir 6 magnetic toner particles comprised of toner resin particles, and magnetite in an amount of from about 65 percent by weight to about 50 percent by weight. Illustrative examples of magnetites that can be selected for incorporation into the toner resin particles include those commercially available such as Mapico Black, which is believed to be a mixture of iron oxides, hard irons, MO 4232, and the like. Generally, the magnetite is present in the toner resin particles in an amount of from about 15 percent by weight to about 50 percent by weight, and preferably in an amount of from about 20 percent by weight to about 40 percent by weight. It is important that a magnetic toner be selected for the development of black images since in the subsequent development step wherein a color developer mixture is applied the black toner can be desirably attracted to the rotating magnets contained in the stationary shell, reference FIG. 1 described in detail herein.

Examples of toner resin particles that can be selected for the black developer mixture include polyimides, epoxies, diolefins, vinyl resins and polymeric esterification products of a dicarboxylic acid and a diol comprising a diphenol. Any suitable vinyl resin may be selected for the toner resins of the present application including homopolymers or copolymers of two or more vinyl monomers. Typical of such vinyl monomeric units include: styrene, p-chlorostyrene, unsaturated mono-olefins such as ethylene, propylene, butylene, isobutylene and the like; vinyl esters inclusive of esters of monocarboxylic acids including methyl acrylate, ethyl acrylate, n-butylacrylate, isobutyl acrylate, dodecyl acrylate, n-octyl acrylate, 2-chloroethyl acrylate, phenyl acrylate, methylalpha-chloroacrylate, methyl methacrylate, ethyl methacrylate, butyl methacrylate, and the like; acrylonitrile, and the like; vinyl ketones such as vinyl methyl ketone, vinyl hexyl ketone, methyl isopropenyl ketone and the like; styrene butadiene copolymers, and mixtures thereof.

As one preferred toner resin there can be selected the esterification products of a dicarboxylic acid and a diol comprising a diphenol. These materials are illustrated in U.S. Pat. No. 3,590,000, the disclosure of which is totally incorporated herein by reference. Other preferred toner resins include styrene/methacrylate copolymers, and styrene/butadiene copolymers, polyester resins obtained from the reaction of bis-phenol A and propylene oxide, followed by the reaction of the resulting product with fumaric acid, and branched polyester resins resulting from the reaction of dimethylterephthalate, 1,3-butanediol, 1,2-propanediol, and pentaerthriol. These toner resin particles are also selected for incorporation into the color developer mixture for reservoir 8.

Included in reservoir 8, in addition to the toner resin particles, are color pigment particles, including magenta, cyan, yellow, red, or green, and the like, as well as mixtures thereof. More specifically, with regard to obtaining color images with the developer mixture as contained in reservoir 8, illustrative examples of magenta materials that may be selected as pigments include 2,9-dimethyl-substituted quinacridone and anthraquinone dye, identified in the color index as Cl 26050; Cl Dispersed Red 14, a diazo dye identified in the color index as Cl 26050; Cl Solvent Red 19; and the like. Illustrative examples of cyan materials that may be used as pigments include copper tetra-4(octadecyl sulfonamido)phthalocyanine; X-copper phthalocyanine pigment, listed in the color index as Cl 74160; Cl Pigment blue; and Anthrathrene Blue, identified in the color index as Cl 69810; Special Blue X-2137; and the like; while illustrative examples of yellow pigments that may be selected include diarylide yellow 3,3-dichlorobenzidene acetoacetanilides, a monoazo pigment identified in the color index as Cl 12700, Cl Solvent Yellow 16, a nitrophenyl amine sulfonimide identified in the color index as Foron yellow SE/GLN, Cl dispersed yellow 33, 2,5-dimethoxy-4-sulfonanilide phenylazo-4'-chloro-2,5-dimethoxy aceto-acetanilide, permanent yellow FGL, and the like.

These pigment particles are generally present in the toner composition in an amount of from about 2 weight percent to about 20 weight percent, and preferably in an amount of from about 2 weight percent to about 10 weight percent. Other pigments not specifically mentioned herein can be selected providing the objectives of the present invention are achieved, these pigments including, for example, lithol scarlet red, reference U.S. Pat. No. 4,410,617, the disclosure of which is totally incorporated herein by reference.

Illustrative examples of carrier particles that can be selected for mixing with the toner particles of the present invention include those that are capable of triboelectrically obtaining a charge thereon in relationship to the toner composition. Therefore, the carrier particles are selected, for example, enabling the black magnetic toner to be positively charged and enabling the toner compositions with colored pigments thereon to be negatively charged. Alternatively, the black magnetic toner particles may be negatively charged and the color toner composition may be positively charged. Illustrative examples of carrier substances selected include glass, steel, nickel, iron ferrites, and the like. Additionally, there can be selected as carrier particles nickel berry carriers as disclosed in U.S. Pat. No. 3,847,604, the disclosure of which is totally incorporated herein by reference, which carriers are comprised of nodular carrier beads of nickel, characterized by surfaces of reoccurring recesses and protrusions thereby providing particles with a relatively large external area. The selected carrier particles can be used with or without a coating, the coating generally containing fluoropolymers, such as methylmethacrylate, and a silane, such as triethoxy silane, tetrafluoroethylenes, other known coatings and the like.

The diameter of the carrier particles can vary, generally the diameter is from about 50 microns to about 300 microns, thus allowing these particles to possess sufficient density and inertia to avoid adherence to the electrostatic images during the development process. The carrier particles can be mixed with the toner particles in various suitable combinations, however, best results are obtained when about 1 part to about 10 parts toner to about 200 parts by weight of carrier are mixed.

Various suitable imaging members can be selected for the process and apparatus of the present invention such as those described in U.S. Pat. No. 4,265,990, the disclosure of which is totally incorporated herein by reference. Thus, for example, layered photoresponsive imaging members containing a photogenerating layer and a diamine hole transport layer can be selected as the deflected flexible imaging member. Examples of photogenerating compositions include metal phthalocyanines, metal-free phthalocyanines, vanadyl phthalocyanines, squaryliums, amorphous selenium, trigonal selenium, selenium alloys, and the like. One specific layered photoresponsive imaging device preferred for the process and apparatus of the present invention is comprised of a photogenerating layer of trigonal selenium, and coated thereover, a hole transport layer comprised of the diamine N,N'-diphenyl-N,N'-bis(methylphenyl)-[1,1-biphenyl-4,4-diamine], dispersed in an amount of about 40 percent in a resinous polycarbonate binder.

Other modifications of the present invention may occur to those skilled in the art based upon a reading of the present disclosure. These are intended to be included within the scope of the present invention including equivalents thereof.

I claim:

1. An improved apparatus for causing the development of electrostatic latent images of an imaging member consisting essentially of providing a moving deflected flexible imaging member; a moving toner transporting means, a development zone situated between said members, with the distance between the flexible imaging member and the transporting member being from about 0.05 millimeters to about 1.5 millimeters, a first developer reservoir with magnetic developer particles, a second developer reservoir with colored developer particles, and a magnetic separator comprised of a stationary shell with rotating magnets therein.

2. An apparatus in accordance with claim 1 wherein the magnets are rotating at a speed of from 100 to about 1,000 revolutions per minute.

3. A process for affecting the development of colored images in a single pass xerographic imaging system which comprises providing (1) a moving deflected flexible imaging member, (2) a toner transporting means for a black developer mixture, (3) a moving transporting means for a colored developer mixture, (4) a first developer reservoir containing therein a black magnetic toner composition, (5) a second developer reservoir containing therein a color toner composition, (6) a magnetic separating apparatus containing a stationary shell having situated therein rotating magnets, and (7) removing black magnetic toner particles from the second toner transporting means by the attraction of these particles to the magnets present in the magnetic separator, whereby contamination of the color developer mixture is substantially eliminated.

4. A process in accordance with claim 3 wherein the first black magnetic toner developer transporting means is biased to from about −400 volts to about −500 volts.

5. A process in accordance with claim 3 wherein the second color developer transporting means is charged from about −400 volts to about −300 volts.

6. A process in accordance with claim 3 wherein the black developer mixture is comprised of toner resin particles and magnetite particles in an amount of from about 15 percent by weight to about 50 percent by weight.

7. A process in accordance with claim 3 wherein the color developer mixture is comprised of toner resin particles and pigments selected from the group consisting of cyan, magenta, yellow, blue, red and green.

8. A process in accordance with claim 3 wherein the black toner mixture is positively charged, and the color toner mixture is negatively charged, and there is achieved images by providing the apparatus of claim 1 and generating thereon images with black information at a voltage of from about −800 volts to about −700 volts, images with white information at a voltage of from about −350 to −450 volts, and images with color information at a voltage of from about zero (0) volts to about −100 volts.

9. An improved apparatus in accordance with claim 1 wherein the deflected flexible imaging member is moving at a speed of from about 5 cm/sec to about 50 cm/sec, and the transporting means is moving at a speed of from about 6 cm/sec to about 100 cm/sec.

10. An apparatus in accordance with claim 1 wherein the magnetic separator further includes therein a blade means, a housing wall, and a reservoir means.

* * * * *